United States Patent [19]

Kawamura

[11] 4,432,317

[45] Feb. 21, 1984

[54] METHOD AND APPARATUS FOR CONTROLLING THE IDLING ROTATIONAL SPEED OF AN INTERNAL COMBUSTION ENGINE

[75] Inventor: Takahide Kawamura, Okazaki, Japan

[73] Assignee: Toyota Jidosha Kogyo Kabushiki Kaisha, Toyota, Japan

[21] Appl. No.: 283,196

[22] Filed: Jul. 14, 1981

[30] Foreign Application Priority Data

Jul. 16, 1980 [JP] Japan ..... 55-96244

[51] Int. Cl.[3] ..... F02P 1/04; F02P 3/00; F02M 3/00

[52] U.S. Cl. ..... 123/339; 123/320; 123/440

[58] Field of Search ..... 123/339, 320, 324, 352, 123/326, 403, 492, 493

[56] References Cited

U.S. PATENT DOCUMENTS

| | | | |
|---|---|---|---|
| 3,868,933 | 3/1975 | Bigalke et al. | 123/320 |
| 3,881,685 | 5/1975 | Hase et al. | 123/320 |
| 3,964,457 | 6/1976 | Coscia | 123/339 |
| 4,204,483 | 5/1980 | Harada et al. | 123/493 |
| 4,221,191 | 9/1980 | Asano et al. | 123/492 |
| 4,281,631 | 8/1981 | Tamaguchi | 123/339 |
| 4,291,656 | 9/1981 | Miyagi et al. | 123/339 |
| 4,338,899 | 7/1982 | Geiger et al. | 123/339 |

*Primary Examiner*—Raymond A. Nelli

*Attorney, Agent, or Firm*—Cushman, Darby & Cushman

[57] ABSTRACT

The actual rotational speed of an internal combustion engine is detected, and the detected rotational speed is compared with upper and lower limit speed values to generate a control signal indicative of the change in the idle air flow to the engine to maintain the actual rotational speed within a desired range. The idle air flow to the engine is adjusted in response to the generated control signal. The above detection of the actual rotational speed or the adjusting is started after a predetermined period of time is passed from the moment when the engine falls into a predetermined idling condition.

16 Claims, 7 Drawing Figures

METHOD AND APPARATUS FOR CONTROLLING THE IDLING ROTATIONAL SPEED OF AN INTERNAL COMBUSTION ENGINE

BACKGROUND OF THE INVENTION

The present invention relates to a method of and apparatus for controlling the idling speed of an internal combustion engine.

A known method of controlling the idling speed consists of adjusting the position of a throttle valve or a flow-control valve in a throttle valve by-pass intake passage, by using a valve-control motor, such as a step motor or a servo motor, in feedback response to the running speed when the engine is idling.

According to the conventional control method of this type, the feedback control is immediately started when the operating condition of the engine becomes a predetermined idling condition. The predetermined idling condition exists when the throttle valve is at the idling position and the running speed of a vehicle is nearly zero. However, the rotational speed of the engine is not immediately stabilized just after the predetermined idling condition is established; the engine usually runs at a relatively high speed for a while due to the moment of inertia and then runs at a gradually decreasing speed. Therefore, if the feedback control is initiated immediately after the predetermined idling condition is established, as has been done in the conventional art, a so-called undershoot phenomenon takes place in which rotational speed abruptly decreases. In the worst case, the engine stalls.

SUMMARY OF THE INVENTION

It is, therefore, an object of the present invention to provide a method of and apparatus for controlling the idling rotational speed, which is capable of effectively preventing the rotational speed of the engine from being erroneously controlled when feedback control of the idling rotational speed is initiated. According to the present invention, the operating condition of the engine is monitored and an idling state signal is generated when the engine is in a predetermined idling condition. A rotational speed signal is also generated which indicates the actual rotational speed of the engine. After a predetermined period of time is passed from the moment when the idle state signal is generated, the rotational speed signal is compared with upper and lower limit speed signals to generate a control signal which indicates the change in the idle air flow to the engine necessary to maintain the actual rotational speed of the engine within a desired range. The idle air flow to the engine is adjusted in response to the control signal.

The above and other related objects and features of the present invention will be apparent from the description of the present invention set forth below, with reference to the accompanying drawings, as well as from the appended claims.

DETAILED DESCRIPTION OF THE PREFERRED EMBODIMENTS

Figure 1:
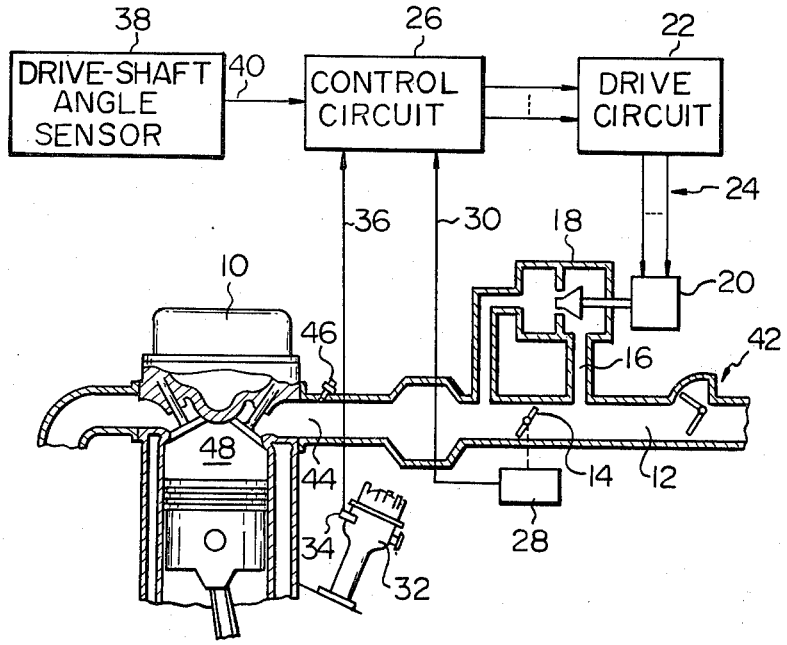
FIG. 1 is a schematic diagram illustrating an embodiment of the present invention.

FIG. 1 schematically illustrates a system for controlling the idling speed, which is applied to an electronically controlled fuel injection-type internal combustion engine according to an embodiment of the present invention. In FIG. 1, reference numeral 10 denotes an engine body, and 12 denotes an intake passage having a throttle valve 14. A control valve 18 is provided in a by-pass intake passage 16 which communicates the intake passage on the upstream side of the throttle valve 14 with the intake passage on the downstream side of the throttle valve 14, by-passing the throttle valve 14; the control valve 18 works to control the cross-sectional area of the passage 16. Further, the opening and closing of the control valve 18 is controlled by a valve control motor 20, such as a step motor or a d-c servo motor. The motor 20 is energized by an electric current which is supplied from a drive circuit 22 via lines 24. The drive circuit 22 is controlled by drive signals from a control circuit 26.

A throttle position switch 28 is mounted on the shaft of the throttle valve 14 to detect whether the throttle valve 14 is located at the idling position. The detection signal is sent to the control circuit 26 via a line 30.

A distributor of the engine is provided with a crank-angle sensor 34 which produces a crank angle pulse or a primary ignition pulse at every rotation of a predetermined crank angle. The crank angle pulses are sent to the control circuit 26 via a line 36.

A drive-shaft angle sensor 38 produces an angle pulse at every predetermined-angle rotation, of a rotary shaft such as a drive shaft or a shaft for driving the speedmeter which rotates a predetermined angle is proportion to the turn of a wheel of the vehicle on which the engine is mounted. The angle pulses from the sensor 38 are fed to the control circuit 26 via a line 40.

As is well known, in electronic control fuel injection-type internal combustion engines, the flow rate of the intake air sucked into the engine is detected by an air-flow sensor 42 disposed in the intake passage 12, and fuel is supplied in an amount in accordance with the detected flow rate of the intake air into a combustion chamber 48 of the engine from a fuel injection valve 46 mounted in an intake manifold portion 44. Therefore, the rotational speed of the engine can be controlled by controlling the flow rate of intake air by the throttle valve 14 or the control valve 18.

Figure 2:
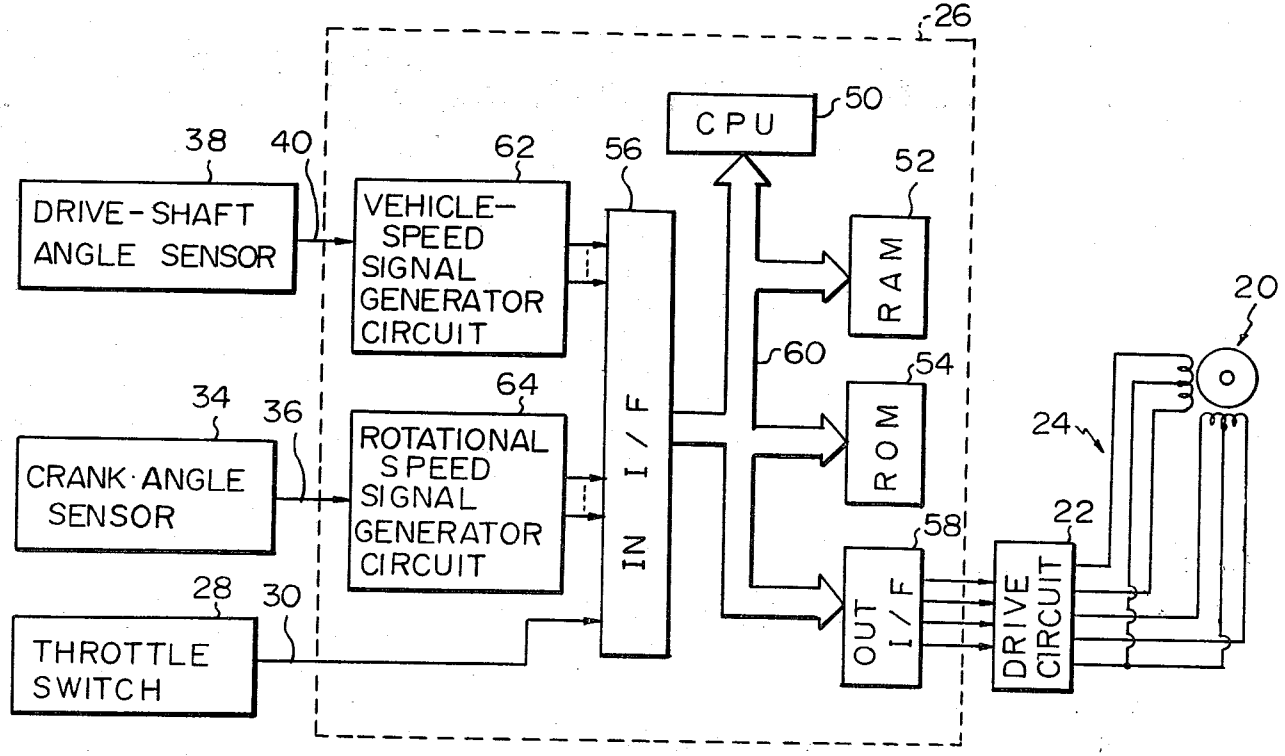
FIG. 2 is a block diagram illustrating an example of the control circuit of FIG. 1.

FIG. 2 is a block diagram illustrating an example of the control circuit 26 of FIG. 1. In this case, a digital computer of the stored program type is used in the control circuit 26. The digital computer consists of a central processing unit (CPU) 50 which executes a variety of calculations, a random access memory (RAM) 52 which is capable of temporarily storing data, a read-only memory (ROM) 54 which stores the control programs, calculation constants and various tables used for the calculations, an input interface 56, and an output interface 58. All of these elements are interconnected via a bus 60.

The input interface 56 receives binary vehicle-speed signals that represent the running speed of the vehicle fed from a vehicle-speed signal generator circuit 62 which is made up of a conventional circuit for measuring, relying upon a counter or the like, the time interval between the angle pulses from the, drive-shaft angle sensor 38. The input interface further receives binary rotational speed signals which represent the rotational speed of the engine fed from a rotational speed signal generator circuit 64 which is made up of a conventional circuit for measuring, relying upon a counter or the like, the time interval of the crank-angle pulses from the crank-angle sensor 34. The input interface 56 further receives a throttle switch signal of the level "1" or "0" which represents whether the throttle valve 14 is at the idling position or not, and which is produced by the throttle position switch 28. According to the embodiment of FIG. 2, the drive circuit 22 for driving the valve-control motor 20 which consists of a step motor is connected to the output interface 58. An electric current for exciting the step motor is produced by the drive circuit 22 responsive to a drive signal of four bits fed from the CPU 50 via the bus 60 and the output interface 58.

The operation of the embodiment will be illustrated below with reference to a flow chart shown in FIG. 3 which schematically represents the flow of an interrupt processing program for controlling the idling speed that is stored in the ROM 54.

Figure 3A:
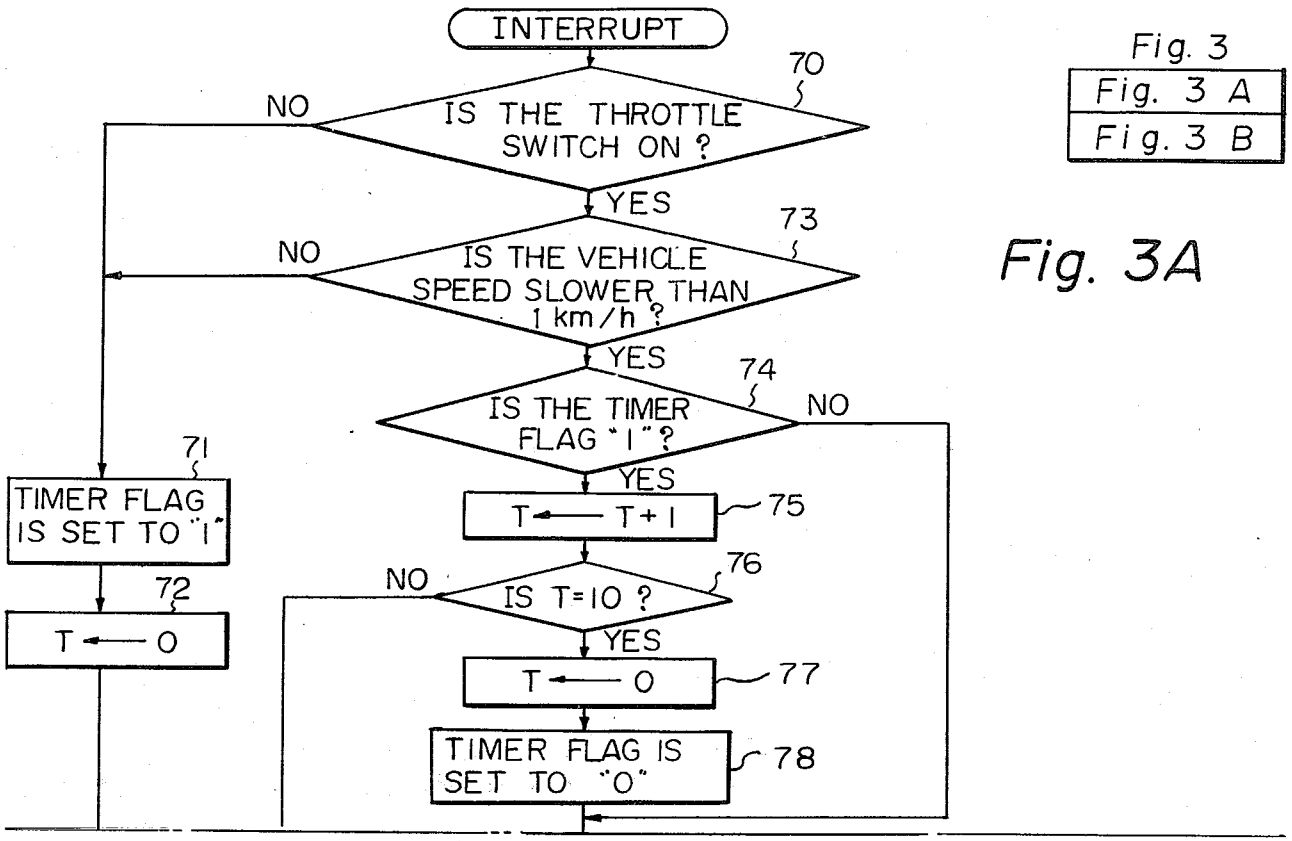
FIGS. 3*a* and *b* are a flow chart illustrating a control program of the embodiment of FIG. 1.
Figure 3B:
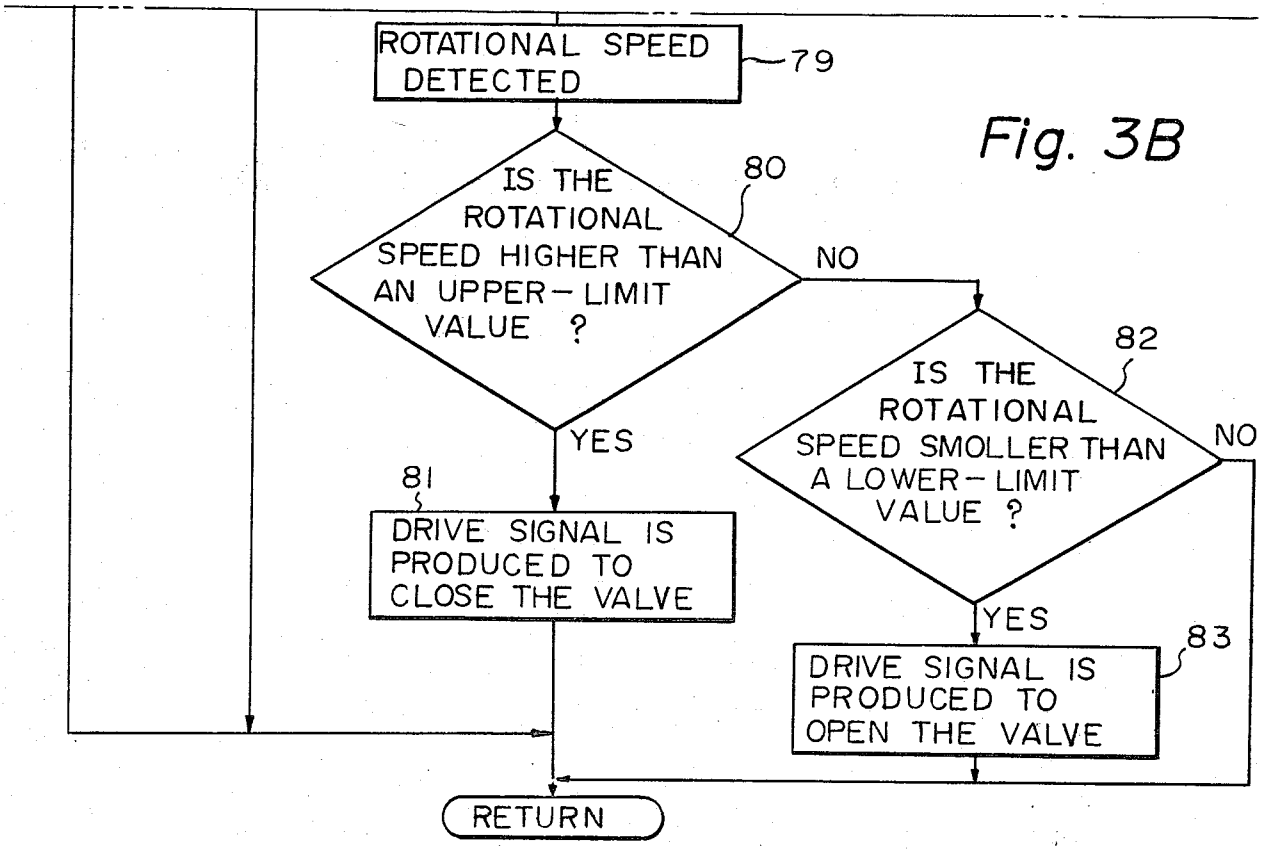

The CPU 50 executes the interrupt processing routine of FIG. 3 in response to an interrupt request which is produced at every 100 milliseconds. At a point 70 the CPU 50 discriminates whether the throttle switch signal from the throttle position switch 28 is "1" or "0". When the throttle switch signal is "1 ", i.e., when the throttle valve is not at the idling position, the program proceeds to points 71 and 72 where the timer flag, that will be used in subsequent processing, is set to "1", and T, which will be used in a subsequent time-measuring processing, is reset to zero. The interrupt processing routine of this time is thus finished, and the program returns to the main routine.

When it is so discriminated at the point 70 that the throttle switch signal is "0", i.e., when the throttle valve 14 is at the idling position, the program proceeds to a point 73 where it is discriminated, relying upon the vehicle-speed signal, whether the present vehicle speed is smaller than 1 km per hour or not. When the vehicle speed is equal to or greater than 1 km per hour, the program proceeds to the points 71 and 72. When it is so discriminated that the vehicle speed is smaller than 1 km per hour, the program proceeds a point 74 presuming that the engine is under the predetermined idling condition. According to this embodiment as mentioned above, the predetermined idling condition is established when the throttle valve is at the idling position and when the vehicle speed is smaller than 1 km per hour. In the above-mentioned embodiment, the digital signal having a value corresponding to the present vehicle speed is formed by the vehicle-speed signal generator circuit 62, and whether the signal represents the vehicle speed of smaller than 1 km per hour is discriminated by the CPU 50. However, the above discrimination may be effected in the vehicle-speed signal generator circuit 62, and a signal "1" or "0" which is the result of discrimination may be fed the CPU 50 via the input interface 56.

At the point 74, the CPU 50 discriminates whether the timer flag is "1" or not. When the engine falls under the predetermined idling condition and thus the program reaches the point 74 for the first time, the timer flag remains at "1". Therefore, the program proceeds to a point 75 where T is increased by one. This T should be set to zero and the timer flag should be set to "1" in the initial processing routine when the engine is started. Then, at a point 76, the CPU 50 discriminates whether T is equal to ten. If T is not equal to ten, the interrupt processing routine is finished and the program returns to the main routine. At the point 76, if it is discriminated that T is equal to ten, the program proceeds to points 77 and 78 where T is reset to zero, the timer flag is set to "0", and the processing routine after the point 79 is executed, i.e., processing routine is executed to control the idling speed by feedback.

According to this embodiment as mentioned above, when the engine operating condition reaches the predetermined idling condition, the idling speed is not immediately controlled by feedback according to points 80 through 83, but is controlled after the interrupt processing of FIG. 3 is performed ten times. Namely, since the interrupt processing routine is effected at a period of 100 milliseconds, the feedback control is initiated when the time period of one second is passed from the moment at which the engine falls into the predetermined idling condition. Once the above-mentioned delay is carried out while the feedback control is being initiated, the timer flag is set to "0" at the point 78. In the subsequent interrupt operation cycles, therefore, the program directly proceeds from the point 74 to the point 79, and the feedback control is immediately executed without delay.

Below is mentioned the feedback control processing in the points 79 through 83.

As the program reaches the point 79, the CPU 50 introduces a rotational speed signal which represents the actual rotational speed of the engine, from the rotational speed signal generator circuit 64, and at the point 80, the CPU 50 discriminates whether the rotational speed is greater than a predetermined upper-limit value of idling speed or not. When the rotational speed of the engine is greater than the upper-limit value, the program proceeds to the point 81 where a drive signal is produced to the output interface 58 so that the control valve 18 is driven toward the closing direction. In the embodiment of FIG. 2, if the valve control motor 20 is a step motor of the four-pole two-phase excitation type, the drive signal will take the form of any one of "1100", "0110", "0011" or "1001". If it is presumed that a drive signal corresponding to the present position of the step motor 20 takes the form "0110", the drive signal of, for example, "1100" should be produced to the output interface 58 at the point 81. The drive circuit 22 then generates an exciting current to the phase which corresponds to "1" of the drive signal. Therefore, the step motor 20 is turned by one step in a given direction, and the control valve 18 is actuated by a predetermined amount toward the direction to close the valve. Therefore, the flow rate of the intake air is reduced correspondingly, causing the rotational speed to decrease.

If it is so discriminated in the point 80 that the actual rotational speed is slower than the upper-limit value, the program proceeds to the point 82 where it is discriminated whether the actual rotational speed is slower than the predetermined lower-limit value of the idling speed or not. When the actual rotational speed is smaller than the lower-limit value, the program proceeds to the point 83 where a drive signal is fed to the output interface 58 so that the control valve 18 is driven toward the opening direction. This means that a drive signal is produced in order to rotate the valve control motor 20 in the opposite direction. Therefore, the flow rate of the intake air sucked into the engine is increased causing the rotational speed to increase.

When it is so discriminated in the point 82 that the actual rotational speed equal to or greater than the lower-limit value, i.e., when the rotational speed lies within a range of upper-limit value and lower-limit value of idling speed, the interrupt processing routine is finished without changing the position of the valve control motor 20.

Figure 4:
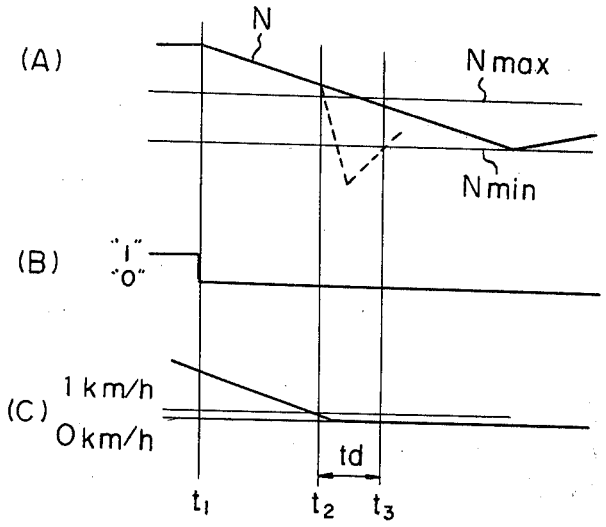
FIG. 4 is a graph illustrating the functions and effects of the embodiment of FIG. 1.

FIG. 4 is a diagram illustrating the functions and effects of the above-mentioned embodiment. In FIG. 4, (A) denotes the rotational speed of the engine, (B) denotes a throttle switch signal, and (C) denotes the vehicle-speed characteristics, relative to the lapse of time. When the throttle valve 14 is returned to the idling position at a moment $t_1$, the throttle switch signal is inverted from "1" to "0" as shown in FIG. 4 (B). As the vehicle speed becomes smaller than 1 km per hour at a moment $t_2$ as indicated in (C), the predetermined idling condition is established. According to the conventional art, the feedback control was immediately initiated at the moment $t_2$. As represented in FIG. 4 (A), therefore, the rotational speed N of the engine of that moment was often higher than the upper-limit idling speed Nmax due to the moment of inertia and, consequently, the control valve 18 was driven toward the closing direction causing the rotational speed to be drastically decreased, as indicated by a broken line. In the worst cases, therefore, the engine often stalled. According to the embodiment of the present invention, however, when the feedback control is initiated, it is lagged by a time $t_d$ (for example, one second) behind the moment $t_2$ at which the predetermined idling condition is established. Therefore, the rotational speed is stabilized through the time $t_d$ and lies between the upper-limit value Nmax and the lower-limit value Nmin as indicated by a solid line in FIG. 4 (A). According to the present invention, therefore, the above-mentioned undesirable phenomenon inherent in the conventional art does not take place.

The above embodiment of FIG. 2 has employed a step motor to drive the control valve 18. However, it is, of course, allowable to control the valve 18 by using a d-c servo motor instead of the valve control motor.

According to the above-mentioned embodiment, furthermore, the opening degree of the flow-control valve in the by-pass intake passage is adjusted to control the flow rate of the intake air when the engine is in the idling condition. The method of the present invention, however, can also be applied to an engine which does not have the by-pass intake passage and in which the closing position of the throttle valve is controlled to control the flow rate of the intake air when the engine is in the idling condition.

Figure 5:
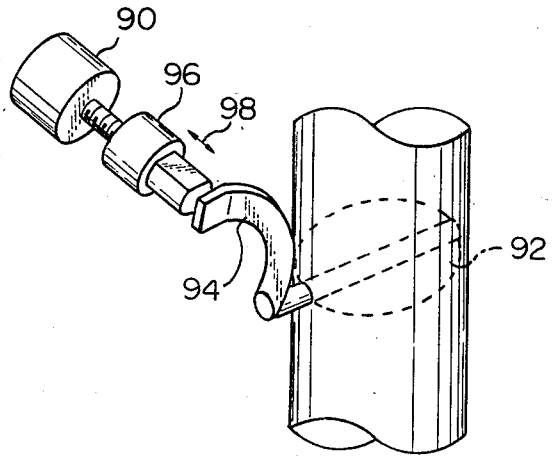
FIG. 5 is a perspective diagram illustrating another constitution of the idle air flow adjusting mechanism of the present invention.

FIG. 5 illustrates a setup for mechanically coupling the valve control motor 90 to the throttle valve 92 when the present invention is applied to engines of this type. Referring to FIG. 5, the tip of an arm 94, attached to the rotary shaft of the throttle valve 92, pushes the end surface of a linear actuator member 96. The end surface of the linear actuator member 96 serves as a stopper. As the motor 90 rotates, the linear actuator member 96 moves in the directions of the arrow 98. Therefore, the closing position of the throttle valve 92 or, in other words, the opening degree of the throttle valve when the engine is in the idling condition, is controlled responsive to the rotating amount of the motor 90. The rotating amount of the motor 90 can be easily converted into the movement of the linear actuator member 96 in the axial direction by, for example, forming a worm screw on the rotary shaft of the motor 90, and inserting the portion of worm screw into a threaded hole formed in the linear actuator member 96. This mechanism can also be adapted to the coupling between the control valve 18 and the motor 20 in the embodiment of FIG. 1. The setup, operation, functions and effects of a control unit for the motor 90 of the embodiment of FIG. 5 are quite the same as those of the above-mentioned embodiment.

Figure 6:
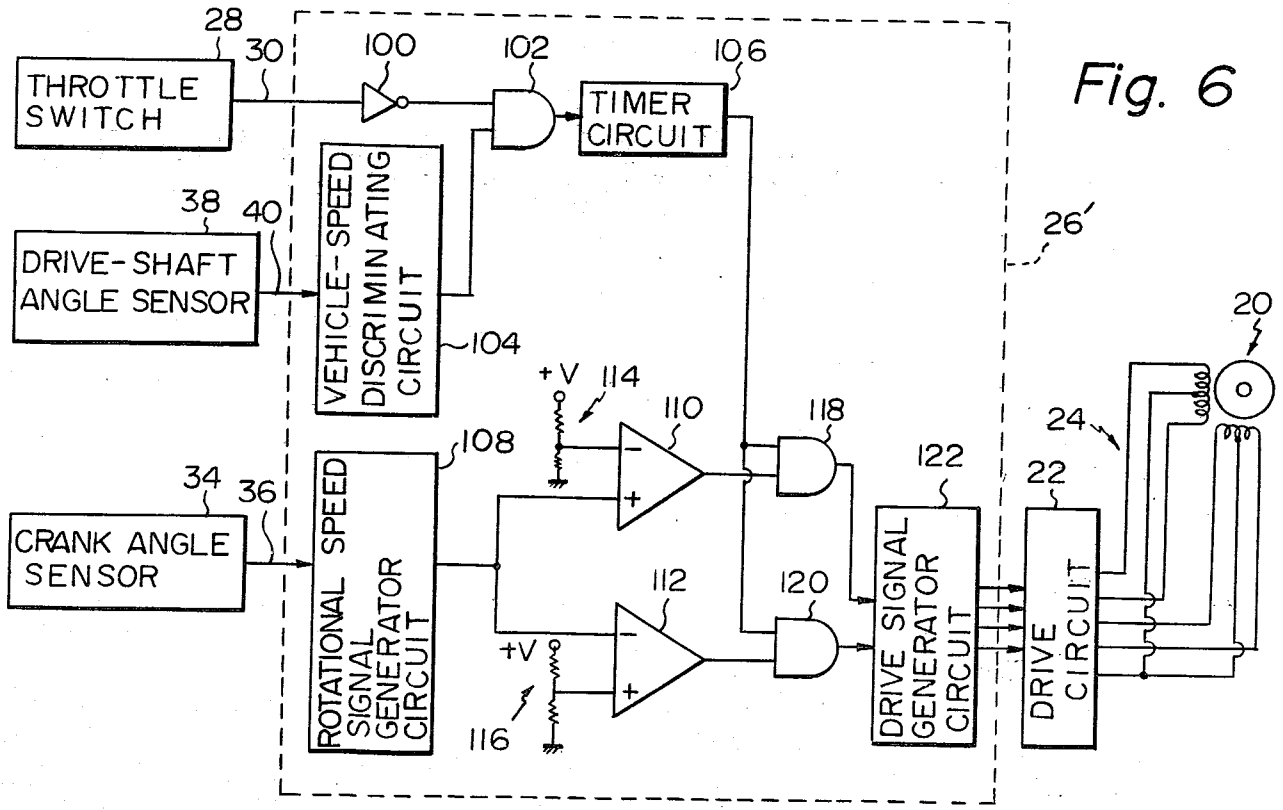
FIG. 6 is a block diagram illustrating another example of the control circuit of the present invention.

FIG. 6 is a block diagram illustrating a further embodiment of the present invention in which the control circuit portion is made up of an analog control circuit 26'. In FIG. 6, the valve control motor 20, the drive circuit 22 for driving the step motor, the throttle position switch 28, the drive-shaft angle sensor 38, and the crank angle sensor 34 are constructed quite in the same manner as those of the above-mentioned embodiment.

A throttle switch signal of the level "0" from the throttle position switch 28, i.e., a signal which indicates that the throttle valve 14 is at the idling position, is inverted by an inverter 100 to the level "1", and is fed to an AND circuit 102. An angle signal from the drive-shaft angle sensor 38 is fed to a vehicle-speed discrimination circuit 104 which produces a signal of the level "1" when the vehicle speed is decreased to below 1 km per hour. Therefore, as the throttle valve 14 comes to the idling position, and the vehicle speed decreases below 1 km per hour, the AND circuit 102 produces the output of the level "1", and a timer circuit 106 commences the operation for measuring the time.

On the other hand, the crank angle signal from the crank angle sensor 34 is fed to the rotational speed signal generator circuit 108 consisting, for example, of a frequency-voltage converter or the like. Therefore, a voltage proportional to the rotational speed of the engine is produced by the generator circuit 108. The output voltage is applied to one input terminal of each of the comparators 110 and 112. The other input terminals of each of the comparators 110 and 112 are, respectively, served with reference voltages that are fed from reference voltage circuits 114 and 116 and correspond to the upper-limit value and lower-limit value of the idling speed. Therefore, when the rotational speed of the engine becomes greater than the upper-limit value, the comparator 110 produces a signal of the level "1". Further, when the rotational speed becomes smaller than the lower-limit value, the comparator 112 produces a signal of the level "1".

The output of the timer circuit 106 assumes the level "1" after a predetermined period of time has passed from the moment at which the output of the AND circuit 102 assumed the level "1", i.e., after a predetermined period of time has passed from the moment at which the predetermined idling condition was established. Consequently, and AND circuits 118 and 120 are opened, the outputs from the comparators 110 and/or 112 are applied to the drive signal generator circuit 122, and the idling speed is controlled by feedback.

Upon receipt of a signal of the level "1" from the comparator 110 via the AND circuit 118, the drive signal generator circuit 122 produces a drive signal which drives the valve control motor 20 so that the control valve 18 moves toward the closing direction.

Upon receipt of a signal of the level "1" from the comparator 112 via the AND circuit 120, on the other hand, the drive signal generator circuit 122 produces a drive signal which drives the valve control motor 20 so that the control valve 18 moves in the opposite direction.

Other operations and effects of this embodiment are quite the same as those of the aforementioned embodiment.

According to the method of the present invention as illustrated in detail in the foregoing, the idling speed is controlled by feedback after a predetermined period of time has passed from the moment at which the predetermined idling condition was established. Even when the feedback control is initiated, therefore, the rotational speed is not erroneously controlled, there does not take place the undershooting phenomenon with regard to the rotational speed, and the engine does not stall.

As many widely different embodiments of the present invention may be constructed without departing from the spirit and scope of the present invention, it should be understood that the present invention is not limited to the specific embodiments described in this specification, except as defined in the appended claims.

We claim:

1. A method of controlling the idling rotational speed of an internal combustion engine by adjusting idle air flow thereto, said method comprising the steps of:

generating an idling state signal when said engine is in a predetermined idling condition;

generating a rotational speed signal related to the actual rotational speed of said engine;

after a predetermined period of time after said idling state signal is generated, comparing said rotational speed signal with upper and lower limit speed signals to generate a control signal which indicates a change in idle air flow to the engine to maintain the actual rotational speed of said engine within a desired range; and adjusting the idle air flow to the engine in response to said control signal.

2. A method as claimed in claim 1, wherein said engine has an intake passage and a throttle valve disposed in the intake passage, and said step of generating an idling state signal includes a step of detecting when the vehicle speed is lower than a predetermined speed and also the throttle valve stays at the idle position.

3. A method as claimed in claim 1 or 2, wherein said step of adjusting the idle air flow includes the step of adjusting, in response to said control signal, the sectional area of a bypass passage which communicates the intake passage at a position located upstream of the throttle valve with the intake passage at a position located downstream of the throttle valve.

4. A method as claimed in claim 1 or 2, wherein said step of controlling the idle air flow includes the step of controlling, in response to said control signal, the closed position of the throttle valve.

5. A method of controlling the idling rotational speed of an internal combustion engine by adjusting idle air flow thereto, said method including the steps of:

generating a rotational speed signal related to the actual rotational speed of said engine;

comparing said generated rotational speed signal with upper and lower limit speed signals to generate a control signal which indicates a change in idle air flow to the engine to maintain the actual rotational speed of the engine within a desired range;

generating an idling state signal when said engine is in a predetermined idling condition; and adjusting the idle air flow to said engine in response to said control signal, said adjusting being started after a predetermined period of time after said idling state signal was generated.

6. A method as claimed in claim 5, wherein said engine has an intake passage and a throttle valve disposed in the intake passage, and said step of generating an idling state signal includes a step of detecting when the vehicle speed is less than a predetermined speed and also the throttle valve stays at the idle position.

7. A method as claimed in claim 5 or 6, wherein said step of adjusting the idle air flow includes the step of controlling, in response to said control signal, the sectional area of a bypass passage which communicates the intake passage at a position located upstream of the throttle valve with the intake passage at a position located downstream of the throttle valve.

8. A method as claimed in claim 5 or 6, wherein said step of adjusting the idle air flow includes the step of controlling, in response to said control signal, the closed position of the throttle valve.

9. An apparatus for controlling the idling, rotational speed of an internal combustion engine by adjusting idle air flow to said engine, comprising:

means for detecting an operating condition of said engine and for generating an idling state signal indicating a predetermined idling condition;

means for detecting the actual rotational speed of said engine and for generating a rotational speed signal indicating said detected actual rotational speed;

means for generating upper and lower limit speed signals;

means for comparing said generated rotational speed signal with said upper and lower limit speed signals and for generating, in response to said comparison, a control signal indicating a change in the idle air flow to said engine needed to maintain the actual rotational speed of said engine within a desired range; and means for adjusting said idle air flow to said engine in response to said control signal after a predetermined period of time from the generation of said idling state signal.

10. An apparatus as claimed in claim 9 wherein:

said engine includes an intake passage and a throttle valve therein; and said operational condition detecting means includes means for generating said idling state signal when the vehicle speed is lower than a predetermined speed and said throttle valve is in an idling position.

11. An apparatus as claimed in claim 10, wherein:

said apparatus further comprises a bypass passage communicating with the intake passage at a position located upstream of the throttle valve and with the intake passage at a position located downstream of the throttle valve; and said means for adjusting the idle air flow includes means for controlling the cross-sectional area of said passage.

12. An apparatus as claimed in claim 10 wherein said adjusting means includes means for controlling said throttle valve idling position.

13. An apparatus as claimed in claim 9, 10, 11 or 12 further comprising means for inhibiting said comparing means for a predetermined period of time after generation of said idling state signal.

14. An apparatus as in claim 12 wherein said throttle valve has a rotatable shaft and said controlling means comprises:

a limit arm attached to said throttle valve rotatable shaft;

linear actuating means for limiting the movement of said throttle valve in a closed direction while said throttle valve is in said idling position, said linear actuating means being adapted to move linearly to adjust the said throttle valve idling position; and means for driving said actuating means in response to said control signal.

15. An apparatus as in claim 9, 10, 11 or 12 wherein:

said rotational speed detecting means generates said rotational speed signal in analog form;

said upper and lower limit generating means generate said upper and lower limit speed signals as first and second voltages;

said comparing means includes first and second comparators, each responsive to said rotational speed signal, said first comparator also being responsive to said first voltage and said second comparator being responsive to said second voltage, the output of said comparators being said control signal; and gate means for passing said control signal to said actuating means in response to said idling state signal.

16. An apparatus as in claim 9, 10, 11 or 12 wherein:

said rotational speed detecting means generates said rotational speed signal in digital form; and said limit signals generating means and said comparing means includes processing means for performing said comparing function only after a predetermined period of time from the generation of said idling state signal to generate said control signal.

* * * * *